US005664708A

United States Patent [19]

Sacks

[11] Patent Number: 5,664,708

[45] Date of Patent: Sep. 9, 1997

[54] TIE AND BELT HOLDER

[76] Inventor: Abraham Sacks, 4272 Sandburg Way, Irvine, Calif. 92612

[21] Appl. No.: 440,313

[22] Filed: May 12, 1995

[51] Int. Cl.[6] ..... A47G 25/74; A47G 25/28

[52] U.S. Cl. ..... 223/85; 223/DIG. 1; 223/DIG. 4

[58] Field of Search ..... 223/85, DIG. 1, 223/DIG. 2, DIG. 4, 1, 88; 211/115, 95; 248/340, 304; D6/315, 323

[56] References Cited

U.S. PATENT DOCUMENTS

| | | | |
|---|---|---|---|
| D. 206,638 | 1/1967 | Van Dusen | 223/DIG. 1 |
| D. 344,853 | 3/1994 | Russo | D6/323 |
| 303,177 | 8/1884 | Miller | 211/115 |
| 2,459,417 | 1/1949 | Dodge | 211/115 |
| 2,842,329 | 7/1958 | Friedman | 248/390 |
| 3,370,715 | 2/1968 | Kolozsvari | 211/116 |
| 4,709,838 | 12/1987 | Campbell | 223/DIG. 4 |
| 5,163,590 | 11/1992 | Lawler et al. | 223/88 |

*Primary Examiner*—Bibhu Mohanty

[57] ABSTRACT

A tie or belt holder, comprising a plurality of extended arms projecting from a ring member, and the arms each have a raised end portion to prevent a tie or belt from sliding off the end and a concave-shaped flat top portion to prevent the tie or belt from slipping off from a side, a hanging member having a hanging portion at one end thereof for cooperation with a closet rail; the ring member and the hanging member are readily connectable and disconnectable. The hanging member includes a connector for connection with the ring member and holding the hanging member joined with the ring member and permitting relative rotation between the hanging member and the ring member while preventing axial movement between the hanging member and the ring member and for disassembly of the ring member and the hanging member to allow shipment of the hanging member and the ring member in a non-joined condition.

18 Claims, 4 Drawing Sheets

FIG. 6
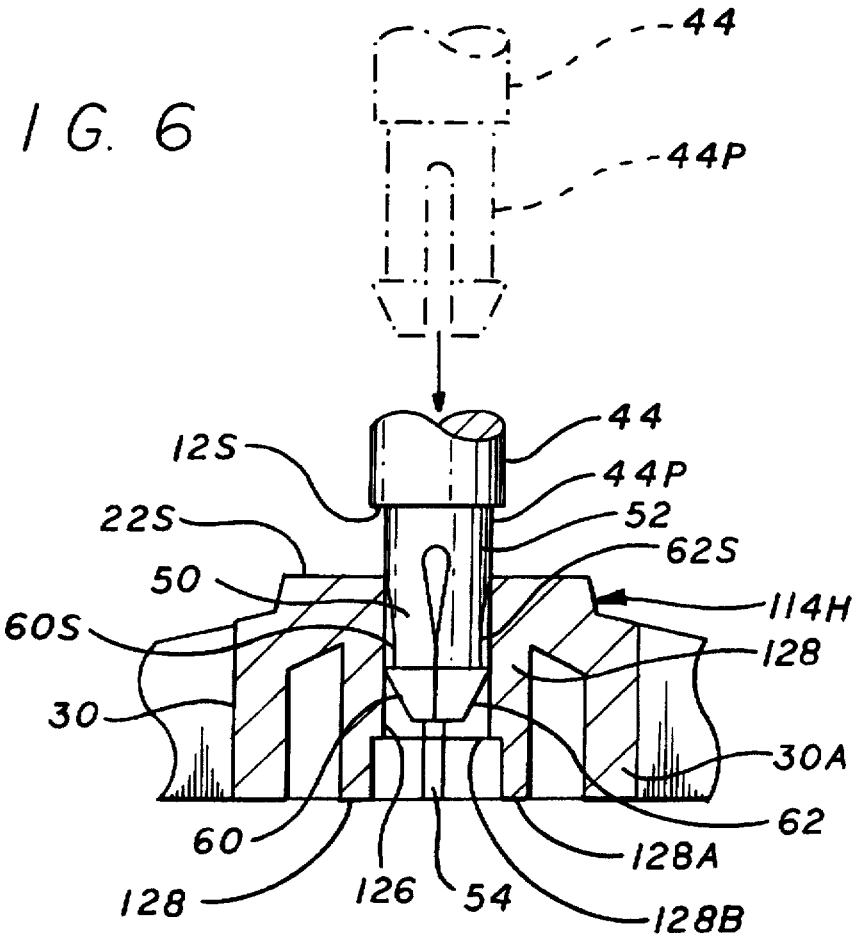
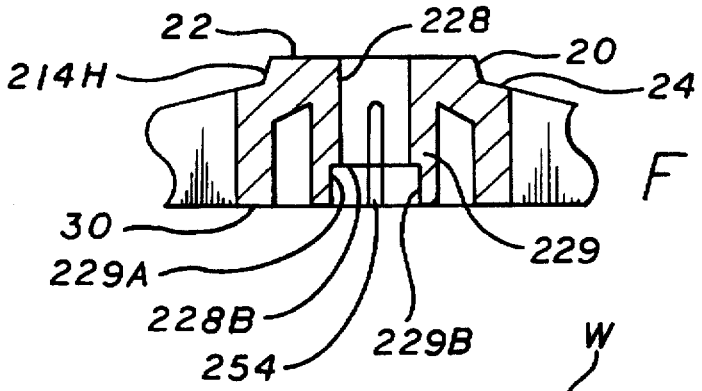
FIG. 7
FIG. 8
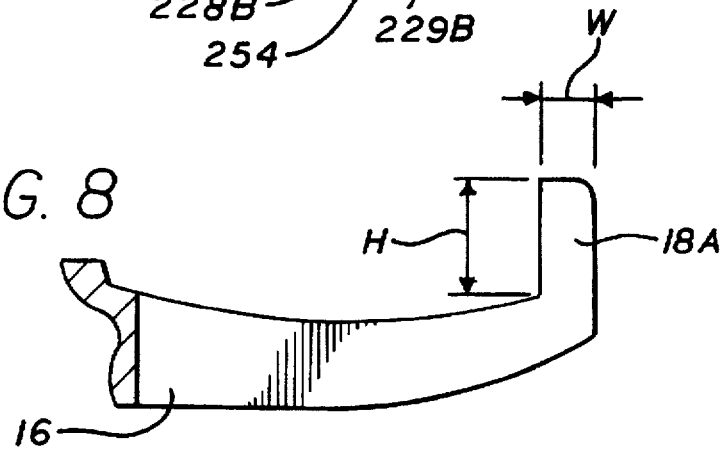

TIE AND BELT HOLDER

BACKGROUND OF THE INVENTION

1. Field of the Invention

This invention relates to a clothing holder and more particularly to a tie and belt holder suitable for holding ties and belts so that they are readily visible and accessible. The invention is also concerned with a tie and belt holder which can be easily assembled and disassembled.

2. Description of Prior Art

It is well known that heretofore, there has been a considerable amount of devices for use in connection with tie and belt holders.

Some examples of prior art of which I am aware, generally include U.S. Pat. No. 5,082,152 to Chen which discloses a clothing hanger having a pair of bottom hook members formed on two bottom end portions of a cross-bar 5 to hang a womens' skirt, a main hook member 8 being pivotally mounted in a sleeve 1, and an auxiliary cross-bar 4 which can be used to hang a tie.

Kolozsvari U.S. Pat. No. 3,370,715 is another patent of interest and this patent is also concerned with a hanger for neckties to accommodate a plurality of neckties or other pieces of garment in four separate groups arranged in two pairs, and suspended by means of non-detachable hooks.

The prior art also is concerned with clothing devices which can be easily assembled and disassembled.

U.S. Pat. No. 4,739,912 to Klawieter is an example of a hanger made with a molded plastic body and a metal hook which is assembled by forcing the metal hook through an opening in the plastic body, but which cannot be disassembled without destroying the plastic body.

U.S. Pat. No. 5,163,590 to Lawler is concerned with a garment hanger and discloses a complex connection system comprising a hook member with two oppositely disposed thin pieces spaced from a central shaft, with each thin piece being flexible and movable towards the central shaft. Upon insertion into a central aperture of the horizontal bridge member the legs are moved together, and hook member is removable from hanger arms by pressing the two oppositely disposed thin pieces against the central shaft.

SUMMARY OF THE INVENTION

One of the objects of this invention is to provide a garment holder, and in particular a necktie holder which can be used for both the suspension of a belt or a necktie in a wardrobe or closet and each article can be made readily visible and accessible.

Another object of the invention is to provide a holder for belts or neckties that can rotate when suspended to enable the selection of a belt or necktie to be made with ease.

Another object of the invention is to provide for a necktie holder which will prevent a tie from slipping off a hanging or support arm for the tie.

A further feature of the invention is the provision of a necktie holder which will not damage the tie in the process of preventing its becoming disengaged from the holder.

A still further feature of the invention is the provision of a belt holder or support which will prevent the belt from slipping off a hanging or support arm for the belt.

Yet another feature of the invention is the provision of a necktie holder which can be easily assembled and/or disassembled for use by an individual who travels and desires to have a number of different ties and/or belts with them and to hang them in a closet or elsewhere and provide for the same ease of visibility and accessibility.

A still further object of the invention is the provision of a garment hanger particularly suited to support a tie and/or a belt which is composed of a pair of simple parts easily assembled and disassembled, together with providing ease of transport and shipment to an ultimate consumer.

One embodiment of the invention is comprised of a circular-shaped planar support or member having individual radiating arms, radiating from the center of the circular-shaped planar support.

Another embodiment of the invention is comprised of a non-circular or elliptical-shaped planar support or member with a plurality of arms radiating from the center of the two rounded ends and from the midpoint between these centers. A decreased number of individual radiating arms is present in order to provide for the hanging of neckties or small belt buckles at the rounded ends of the planar support and to provide for the hanging of large belt buckles on the elongated parallel sides of the planar support.

A feature of both embodiments is a hanger for suspending the invention and it incorporates the provision of a pair of oppositely disposed claw members each having at its end a hook portion which can be brought together to connect the hook portion with the planar support and which can also be removed by pushing the claw members together to disengage the hook portion from the planar support.

A preferred embodiment of the invention includes a shaped substantially flat support arm having a width of 1/8 to 3/16 of an inch which extends outward from the center of the planar member. It is generally rectangular shaped in cross-section with a fully rounded bottom edge and a flat top edge. The corners of the flat top edge are just sightly rounded to prevent damage to necktie fabric. The top is flat rather than round to increase the degree of friction and to restrain a necktie from slipping off over the top edge. In addition to being flat, the top surface of the support arm is also concave shaped. When a necktie is draped over the support arm the necktie fabric takes up the concave shape of the support and this concavity must be overcome before the necktie can slip, thus increasing the resistance to slipping off over the top edge. The outermost part of the support arm has an upstanding edge retaining member to prevent a tie or belt from slipping off the end of the support arm.

It is also possible to have a grooved or toothed top surface of a non-invasive type to prevent damage to fabric, while assisting in the prevention of slippage over the top edge of the support arm.

Other objects, advantages, and the nature of the inventions will become apparent from the detailed description of the invention taken in connection with the accompanying drawings.

BRIEF DESCRIPTION OF THE DRAWINGS

FIG. 6 is a partial sectional view similar to the sectional view shown in FIGS. 3 and 5 illustrating a modification of the embodiment of FIGS. 1 and 4 and illustrating a partial assembly of the hanging member and planar support member;

FIG. 7 is another partial sectional view similar to the sectional view shown in FIGS. 3 and 5 illustrating another modification;

FIG. 8 is a partial sectional view of one extending arm of the planar support members showing a modification of an edge corner of one of the extending arms of the tie and belt holder of FIGS. 1 to 3 and FIGS. 4–5.

DESCRIPTION OF THE PREFERRED EMBODIMENTS

Referring now more particularly to the drawings which show the various modes presently contemplated for carrying out the invention.

Figure 1:
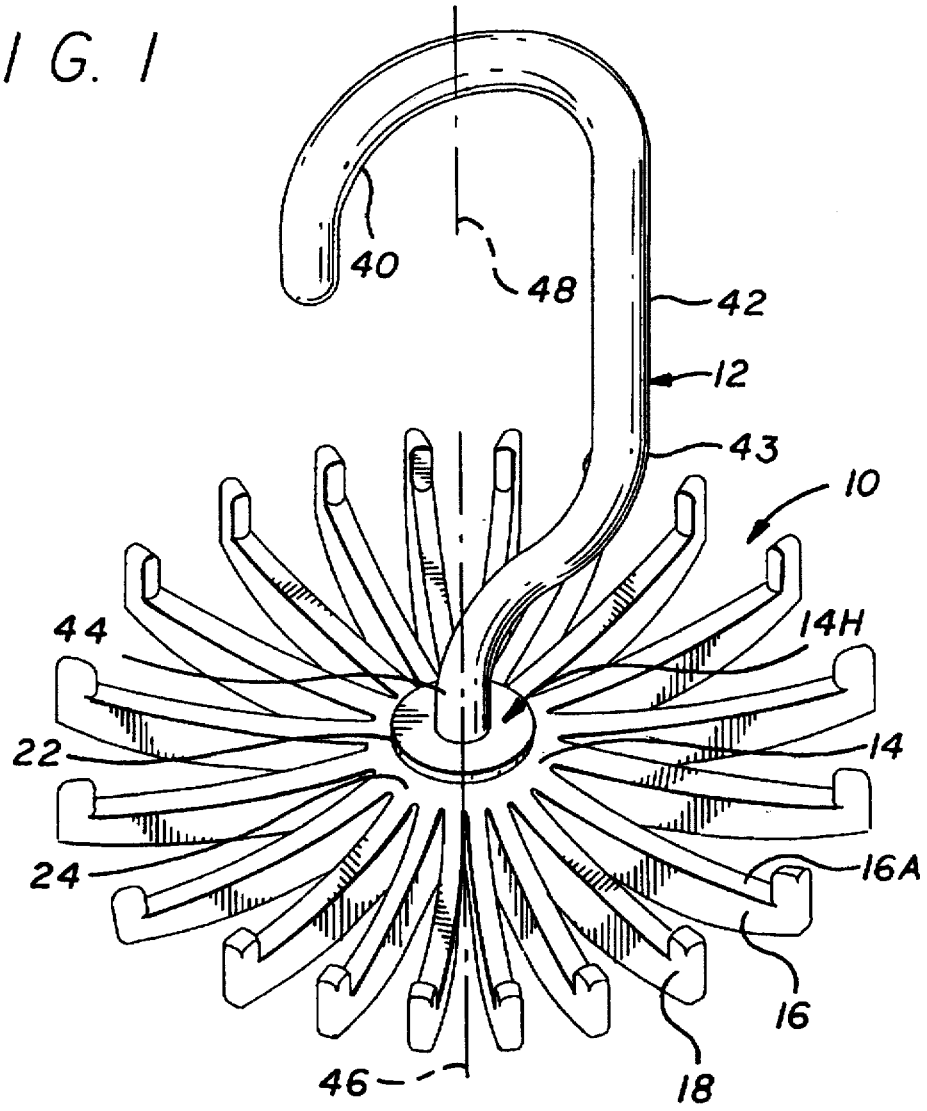
FIG. 1 is a perspective view of a hanging member and circular-shaped planar support member of one embodiment of a tie and belt holder according to the invention.
Figure 2:
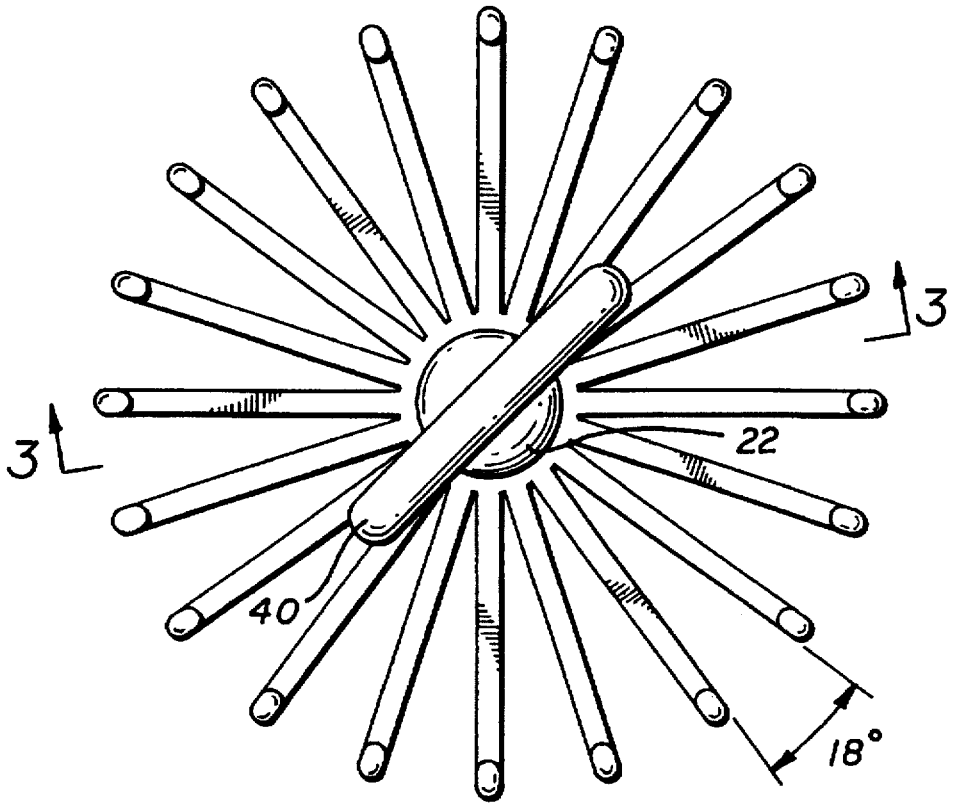
FIG. 2 is a flat plane projection looking from the top down in FIG. 1.
Figure 3:
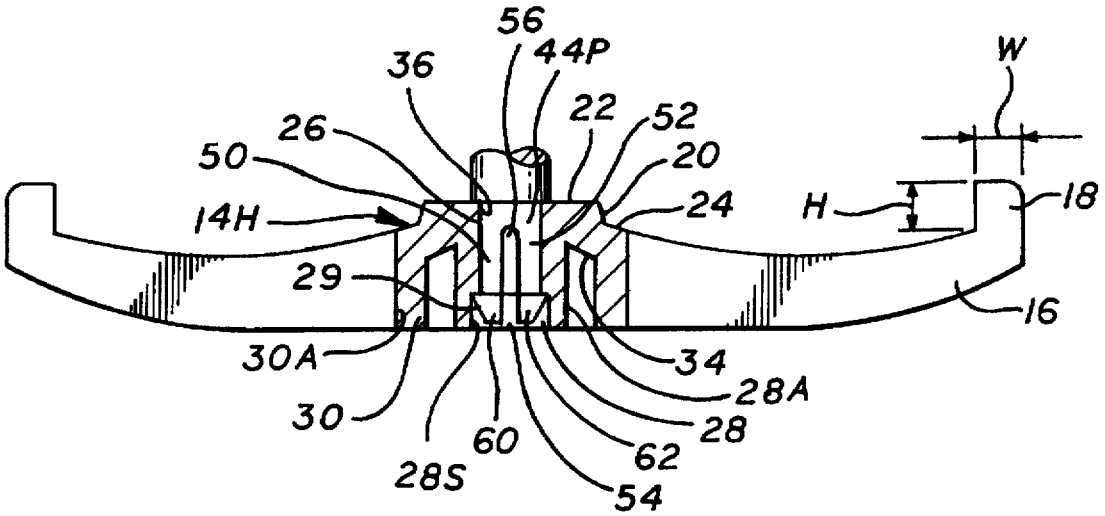
FIG. 3 is a sectional view taken on line 3—3 of FIG. 2.

Referring now more particularly to FIGS. 1 to 3 which illustrates a tie and belt holder 10 including a hanging member 12 and a ring member 14 having a plurality of extending arms 16 each having a raised end portion 18 raised above a top surface 16A to prevent a tie or belt from sliding off the end of one of the extending arms 16.

The same parts in all of the embodiments are designated with the same reference numerals, and specific modifications are designated with related reference numerals. Accordingly, certain reference numerals may appear only in some of the figures.

Ring member 14 includes a hub 14H formed by a circumferential central portion 20 having a raised portion 22 which is raised above an inner high point 24 of arm 16 and includes a central opening 26 surrounded by a first inner cylindrical portion 28 and a second outer cylindrical portion 30 having therebetween a circumferentially extending circular grooved portion 32. The inner high point 24 of arm 16 is at an inner end of arm 16 and is spaced from the end portion 18, for support of a tie or belt or similar article between high point 24 and end portion 18. The extending arms 16 radiate from the hub 14H or central portion 20.

Top 34 of grooved portion 32 extends along an incline and joins inner 28 and outer 30 cylindrical portions so that inner cylindrical portion 28 can be pivotally moved along connection line 36 to widen end 28A of inner cylindrical portion 28 along a portion thereof to effect a slight movement thereof closer to end 30A of outer cylindrical portion to facilitate insertion of the end 44P of hanging member 12 into ring member 14 for connection of hanging member 12 with ring member 14, as will be further explained hereinafter.

Hanging member 12 includes an outer curved handle portion 40 to fit over a typical or conventional closet rail (not shown) and a vertically extending portion 42 which includes a somewhat S-shaped bottom portion 43 terminating in a central portion 44 which has a central axis 46 coinciding with a central axis 48 of the curved handle portion 40 so that ring member 14 will lie in a plane orthogonal to central portion 44 to provide a planar or substantially planar array of the tie and belt extending arms 16.

Hanging member 12 includes the lower end portion 44P which extends into central opening 26 surrounded by the first inner cylindrical portion 28 and locks ring member 14 with hanging member 12 once they are assembled.

Bottom portion 44P includes a pair of U-shaped semi-cylindrical portions 50, 52 having a U-shaped grooved portion 54 therebetween joined by a curvilinear base portion 56 so that semi-cylindrical portions 50 and 52 can be moved towards each other and press outwardly to engage the inner surface 28S of inner cylindrical member 28. Semi-cylindrical portions 50, 52 have some flexibility because they are formed of a plastic material so that they are pressure engaged with the inner central opening 26.

Semi-cylindrical portions 50, 52 each include a hook member 60, 62 at their ends having a sloping facing surface 60S, 62S for engagement with the facing surface of L-shaped leg portion 29.

Reference is made to FIG. 6 and the parts similar to the part numbers in FIGS. 1 to 3 have been raised by 100, which shows a modified hub 114H in which inner cylindrical member 128 includes one longitudinal slit or U-shaped groove portion 154 to facilitate the movement of the lower edge 128A towards edge 30A.

FIG. 7 shows another modification and the parts similar to the part numbers in FIGS. 1 to 3 have been raised by 200, and hub 214H which includes inner cylindrical member 228 provided with two longitudinal slits or U-shaped portions 254 diametrically opposite from each other. While FIG. 6 shows one slit 54 and FIG. 7 shows two slits 254, a third slit can also be used to facilitate joinder of hanging member 12 and ring member 14, as will be explained in further detail. In FIG. 7, central opening is designated 226 and includes the two slits 254.

Figure 5:
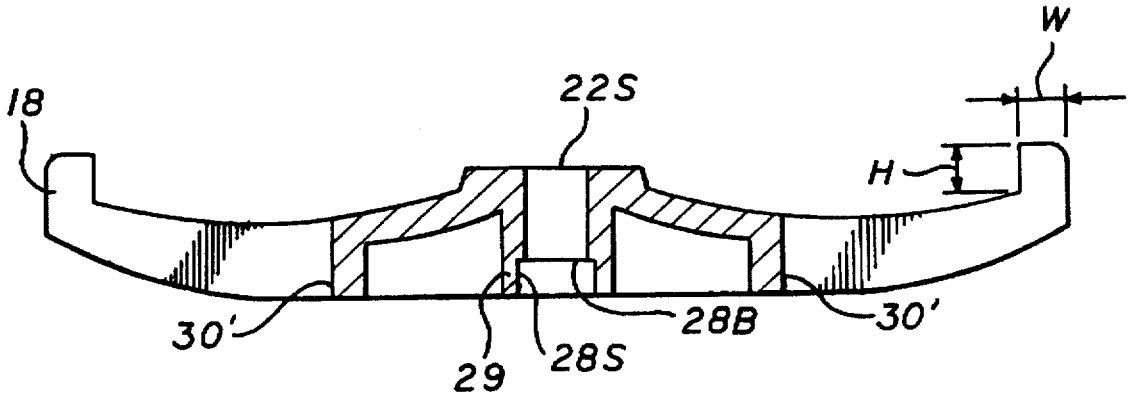
FIG. 5 is a sectional view taken on line 5—5 of FIG. 4, but with hanging member 12 omitted for purposes of explanation.

Referring now more particularly to FIG. 6, central opening 126 is shown with end portion 44P having a pair of U-shaped semi-cylindrical portions 50, 52 forming a pair of opposed substantially semi-cylindrical legs provided with a semi-cylindrical hook member 60, 62, respectively at the ends for connection with the inner peripheral edge 28B, or 228B. As best seen in FIG. 3, and FIG. 5, edge 28B is hooked to hook members 60, 62.

Inner cylindrical member 228 in FIG. 7 includes an L-shaped portion 229 also comprised of a first leg portion 229A, and a second leg portion 229B to the central portion to form a hook end portion which pivots about the connection as described in connection with FIGS. 1 to 3. Each of the leg portions extends in a vertical direction substantially parallel to the central axis 46 and the inner leg portions 229A and 229 can be moved apart from each other. The two spaced semi-cylindrical portions 229A and 229B which can be moved away from each other along U-shaped grooved portions 254 to facilitate the removal and entry of central portion 44P into and out of central opening 226.

As clearly seen in FIG. 3, the first inner cylindrical member 28 is not provided with a slit, but the inner cylindrical member has an internal L-shaped portion 29 which engages hook members 60, 62 thus locking ring member 14 with hanging member 12 in the assembled condition thereof.

As best seen in FIG. 6, a partial view shown in phantom outline of central portion 44 and bottom portion 44P is shown with legs 50 and 52 in their normal condition prior to entry into the central opening 26 in first inner cylindrical member 28 as shown in FIG. 3, or partial opening 126 as shown in this Figure. In order to insert the legs 50, 52 into the central opening, they are pressed together so that hook members 60, 62 can enter into the opening. Also, the hook members 60, 62 are provided with the sloping facing surface 60S, 62S to facilitate entry into opening 126.

Hanging member 12 is provided with a bottom surface 12S which is in face to face contact with the top surface portion 22S of raised portion 22 while hanging member 12 and ring member 14 are locked together.

Because of the cooperation between the leg portions 129B or 229B, or L-shaped member and the hook members 60, 62, the hanging member 12 and ring member 14 can be easily assembled and disassembled whether it be for shipping in a compact or knock-down condition or if someone desires to carry their own tie and belt hanger with them when travelling. The tie and belt hanger can be easily assembled and disassembled in both instances.

Hook members 60, 62 cooperate with bottom surface 12S to lock hanging member 12 together with ring member 14 while permitting relative rotations between hook member 12 and ting member 14, with lower end portion 44P acting as an axle about which the ring member is freely movable for relative rotation but is prevented from axial movement unless hook members 60, 62 are released from the inner cylindrical member.

In the embodiment shown in FIGS. 1 to 3, the ring member 14 is shown with a plurality of radiating arms 16, which are spaced 18 degrees from each other so that the tie and belt holder 10' can accommodate twenty (20) individual ties and/or small belts. Larger belts can be hung over two or more arms.

Figure 4:
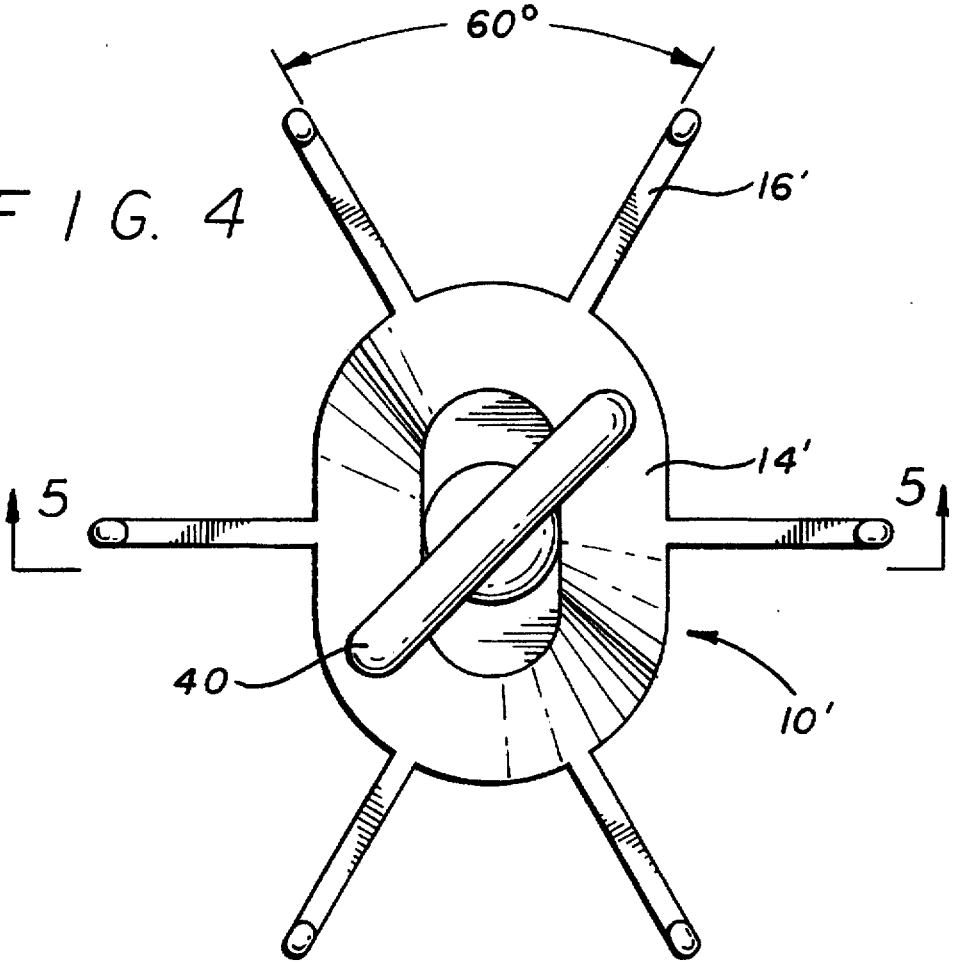
FIG. 4 is a flat plane projection looking down from the top of a hanging member and a non-circular shaped planar support member illustrating another embodiment of the tie and belt holder according to the invention.

Referring now more particularly to FIGS. 4 and 5, which shows a modification of the tie and belt hanger of FIGS. 1 to 3, wherein like parts are designated with the same reference numerals, and modified parts are raised by a prime, the tie and belt holder 10' includes an oval or elliptically shaped ring member 14' having six arms 16' extending therefrom and the arms are spaced 60 degrees from each other. This embodiment is important to illustrate that the holder according to the invention can accommodate wide belts as well as a number of ties on each individual arm with ease.

The inner cylindrical portion 29 is the same as in the FIGS. 1 to 3 embodiment and outer cylinder 30' follows the perimeter of the elliptical form.

Referring now more particularly to FIG. 8 which shows arm 16 or 16' with end portion 18A. This end portion 18A is provided with a height H' approximately double the height H of end portion 18 to enhance the effect that a tie or a large belt or a belt with a large buckle does not slip off the edge of the lateral or radiating arms. While the term tie may conventionally mean a man's or males piece of haberdashery, women now use scarves which are also sometimes designated as ties and which when folded may be of such a height that it slips off a conventional type of arm with an 18 end portion. Therefore, a wider arm together with a concave substantially rectangular portion and a higher end portion provides a substantial holding power with respect to the scarf or thicker tie which is to be supported by the hanger. Accordingly, the clothing hanger for ties and belts can be made with end portion 18A having the height H' approximately double the height of 18. For end portion 18, it is preferred that the height be approximately 3/16–1/4 inch and for end portion 18A the height is preferably about 3/8 inch plus 1/16 inch or more as needed so that a shawl or thick-type of scarf can be hung onto the extending arm.

The width W can be approximately one-quarter of an inch.

Figure 9:
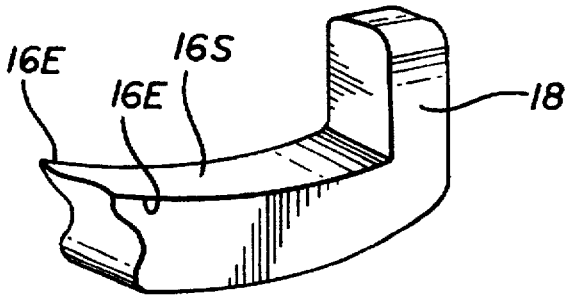
FIG. 9 is a partial perspective view of one extending arm of the planar support members of the holder of FIGS. 1 to 3 and FIGS. 4 to 5.

Referring now more particularly to FIG. 9, which is a partial perspective view of one of its extending arms, the end 18 is raised to prevent ties or belts slipping off the end, and the top surface portion 16S is provided with a width of approximately 1/8–3/16 of an inch wide and is generally rectangular and the edges or comers 16E are slightly rounded to prevent damage to a neck-tie fabric and the substantially flat surface portions increases the degree of friction to prevent damage to the necktie fabric from slipping off over the top edge as would happen if the top of the arm were substantially dowel-shaped or semi-circular. The top surface also has a concave shape.

While there has been shown what is considered to be the preferred embodiments of the invention, it will be obvious to those skilled in the art that various changes and modifications may be made therein without departing from the scope of the invention.

What is claimed is:

1. A tie or belt holder, comprising:

a ring member having a plurality of symmetric extending arms each having a raised end portion to prevent a tie or belt from sliding off the end of said extending arms, said arms each extending longitudinally in a concave profile and having a generally rectangular cross section with a flat top to provide for an increased degree of friction to restrain and to prevent the tie or belt from slipping off from a side of the arm, said arms having having slightly-rounded corners to prevent damage to a fabric forming the tie or belt; and a hanging member having a hook hanging portion at one end thereof for cooperation with a closet rail;

said ring member including first means comprising a hub for connection with said hanging member; and said hanging member including at the other end thereof second means for connection with said hub for joining said ring member and holding said hanging member joined with said ring member to permit relative rotation between said hanging member and said ring member while preventing axial movement between said hanging member and said ring member and to provide for ease of assembly of said ring member and said hanging member.

2. The holder according to claim 1, wherein said ring member includes a circumferential central portion having a raised portion raised above an inner high point of said arm, said hanging member includes a bearing surface for bearing onto said raised portion, said raised portion having a support surface portion in contact with said bearing surface so that said ring member can be rotated relative to said hanging member when connected together with said bearing surface being movable on said support surface, said hub and said raised portion cooperating with each other to maintain said hook member engaged with said hub to prevent axial movement while permitting relative rotation between said hanging member and said ring member, and said inner high point is at an inner end of said arm spaced from an end portion of said arm between which the tie or belt is to be supported.

3. The holder according to claim 1, wherein said ring member includes a circumferential central portion having a central opening, said central portion forming said hub and said plurality of extending arms radiating from said hub, said hub including a first inner substantially cylindrical portion and a second outer cylindrical portion and having therebetween a circumferentially grooved portion.

4. The holder according to claim 3, wherein said first inner substantially cylindrical portion includes at least one longitudinal groove extending axially thereof and parallel with a central axis of said inner substantially cylindrical portion to permit walls of said first inner substantially cylindrical portion to be movable transversely relative to said central axis to permit said hook member to pass said hub when inserting said hook member.

5. The holder according to claim 4, wherein said hook member includes a lower end portion which extends into said central opening for pressure engagement with said first inner cylindrical portion.

6. The holder according to claim 4, wherein said hook member includes a lower end portion receivable within said central opening and having hook means for engagement with said first inner cylindrical portion.

7. The holder according to claim 1, wherein said ring member is circularly-shaped and includes radiating arms spaced 18° apart from each other.

8. The holder according to claim 1, wherein said ring member is an elliptical shaped planar support member having a plurality of radiating arms.

9. The holder according to claim 8, wherein said radiating arms are angularly-spaced from each other 60°.

10. The holder according to claim 1, wherein said end portion varies in height between approximately 3/16 to 7/16 inch.

11. The holder according to claim 3 wherein said first inner cylindrical portion includes a pair of longitudinal grooves extending axially thereof and parallel with a central axis of said inner cylindrical portion to form two semi-cylindrical members, and ends of said two semi-cylindrical members being movable towards and away from each other to increase the diameter of said first inner cylindrical portion when said ends are moved away from each other.

12. The holder according to claim 11, wherein said second means includes a lower end portion which extends into said central opening for pressure engagement with said first inner cylindrical portion, and said lower end portion including sloping facing surface for facilitating only into said central opening.

13. The holder according to claim 3, wherein said first inner substantially cylindrical portion includes a pair of longitudinal grooves extending axially thereof and parallel with a central axis of said inner cylindrical portion forming a pair of semi-cylindrical members and extending to a free peripheral edge of said cylindrical portion to permit said free peripheral edges to be moved apart from each other to increase the diameter therebetween.

14. The holder according to claim 13, wherein said lower end portion includes a pair of legs substantially semi-cylindrical in shape conformed to fit within a recessed portion of said first substantially cylindrical portion.

15. The holder according to claim 14 including hook portions on the end of each of said pair of legs for engagement with the peripheral edge of said pair of semi-cylindrical members to lock said hanging member to said hub to prevent separation thereof while permitting relative rotation.

16. The holder according to claim 15, wherein the inner diameter of said pair of semi-cylindrical members is greater than the outer diameter of said pair of legs, and the diametrical extent of said hook portions is greater than the inner diameters of said pair of semi-cylindrical members, and means forming a connection between said pair of legs to permit said legs to be pivoted about said connection to decrease the diametrical extent of said hook portions to a diameter less than the inner diameter of said pair of semi-cylindrical portions to permit said hook portions to move out of engagement with said semi-cylindrical members to permit separation of said ring member and said hanging member.

17. The holder according to claim 1, wherein said substantially flat support arm has a width of 1/8 to 3/16 of an inch which extends outward from the center of the planar member.

18. A tie or belt holder, comprising:

a ring member having a plurality of symmetric extending arms each having a raised end portion to prevent a tie or belt from sliding off the end of said extending arms, said arms each extending longitudinally in a concave profile and having a generally rectangular cross section with a flat top to provide for an increased degree of friction to restrain and to prevent the tie or belt from slipping off from a side of the arm, said arm being provided with slightly-rounded corners to prevent damage to a fabric forming the tie or belt; and a hanging member having a hanging portion at one end thereof for cooperation with a closet rail;

said ring member including first means comprising a hub for connection with said hanging member; and said hanging member including at the other end thereof second means for connection with said hub for joining said ring member with said hanging member and holding said hanging member joined with said ring member to permit relative rotation between said hanging member and said ring member while preventing axial movement between said hanging member and said ring member.

* * * * *